US009488253B1

(12) United States Patent
Devitt

(10) Patent No.: US 9,488,253 B1
(45) Date of Patent: Nov. 8, 2016

(54) RETRACTABLE CURTAIN

(71) Applicant: Midwest Industries, Inc., Ida Grove, IA (US)

(72) Inventor: Jon W Devitt, Ida Grove, IA (US)

(73) Assignee: Midwest Industries, Inc., Ida Grove, IA (US)

( * ) Notice: Subject to any disclaimer, the term of this patent is extended or adjusted under 35 U.S.C. 154(b) by 0 days.

(21) Appl. No.: 14/877,094

(22) Filed: Oct. 7, 2015

(51) Int. Cl.

| | |
|---|---|
| ***E04H 6/04*** | (2006.01) |
| ***F16H 19/06*** | (2006.01) |
| ***E04H 6/02*** | (2006.01) |
| ***B60J 11/02*** | (2006.01) |
| ***F16H 1/20*** | (2006.01) |
| ***B63B 17/02*** | (2006.01) |

(52) U.S. Cl.
CPC ..... *F16H 19/06* (2013.01); *B60J 11/02* (2013.01); *B63B 17/02* (2013.01); *E04H 6/02* (2013.01); *E04H 6/04* (2013.01); *F16H 1/203* (2013.01)

(58) Field of Classification Search
CPC ..... E04H 6/04
USPC ..... 160/120, 243; 135/87; 52/63
See application file for complete search history.

(56) References Cited

U.S. PATENT DOCUMENTS

| | | | | |
|---|---|---|---|---|
| 642,423 | A * | 1/1900 | Brodie | E06B 9/40 160/113 |
| 3,306,344 | A * | 2/1967 | Youngs | E06B 9/40 160/241 |
| 3,389,738 | A * | 6/1968 | Roth | A47H 23/10 160/120 |
| 5,524,693 | A * | 6/1996 | Hamilton | E06B 9/64 160/120 |
| 6,102,059 | A * | 8/2000 | Miller | E04H 6/04 135/141 |
| 6,401,794 | B1 * | 6/2002 | Hamilton | A47H 21/00 160/121.1 |
| 6,612,359 | B1 | 9/2003 | Moreau | |
| 6,860,310 | B2 * | 3/2005 | Kubly | E06B 9/13 160/122 |
| 6,895,886 | B1 * | 5/2005 | Pawlowski | B63B 59/00 114/361 |
| 6,978,822 | B2 * | 12/2005 | Schoonen | E06B 9/56 160/120 |
| 7,152,653 | B1 * | 12/2006 | Kubly | E06B 9/40 160/120 |
| 8,905,830 | B2 * | 12/2014 | Schmelzer | A01K 1/007 454/337 |
| 2006/0243398 | A1 * | 11/2006 | Schoonen | A01G 9/227 160/120 |

OTHER PUBLICATIONS 27 pages—Clear Span Curtain Tube—Support System (Manual Gearbox)—Single and Double-Output.
30 pages—The Touchless Cover—Measurement & Installation Instructions Boathouse/Intercoastal Permanent Docks—by IMT, Inc.
1 sheet—schematic of a diagram of a Touchless Boat Cover, including a written description.
1 sheet of a schematic (only) of a Touchless Boat Cover.

* cited by examiner

*Primary Examiner* — David Purol
(74) *Attorney, Agent, or Firm* — Sturm & Fix LLP

(57) ABSTRACT

An apparatus for the deployment of four curtains for the sides of boat 'wet slips' and boat lifts, car ports or the like. A synchronized roller system is provided to roll up or down each of the four curtains that surround a space to be enclosed by the curtain system.

12 Claims, 11 Drawing Sheets

RETRACTABLE CURTAIN

TECHNICAL FIELD

This invention relates generally to the deployment of curtains for the sides of boat 'wet slips' and boat lifts, car ports or the like, typically, but not always, that have a top to shelter the space below it from the rain but no sides.

BACKGROUND

Boat owners, particularly owners of relatively small boats (e.g., less than twenty five feet in length) oftentimes find it desirable to moor their boats in slips or boat lifts. These systems provide quick access to the boat and ensure the boat is secured and protected from wave action.

In order to protect the boat from the elements (e.g., the effects of sun and precipitation), a canopy is oftentimes placed over the slip or boatlift to provide a modicum of protection from the weather. This is particularly important for boats with fine wood and fiberglass hulls, as continued exposure to ultraviolet rays from the sun degrade the fine wood (e.g., mahogany and teak woods), finish, fiberglass, and/or substantially any material that the boat may be constructed from and/or contain (e.g., vinyl seats). The more the boat may be brought under the cover of the canopy the better it will be protected from the elements. While a canopy does provide protection against the elements, it only provides the maximum benefit if it is relatively close to the boat itself. A problem occurs, however, in that boaters must have easy access to their boats (i.e., to board and/or load their boats) or the boat geometry limits the canopy placement (wakeboard towers, Bimini tops, etc.). Many boat owners are forced to compromise in their placement of the canopy to allow access to the boat while providing at least some protection.

Other protective devices lower and raise a canopy or cover onto the top of a boat through cables and lines that hang above the boatlift. These canopies, however, due to their use of hanging cables provide the canopy or cover with an undesirable range of motion which extends beyond the vertical plane (i.e., the canopy is free to move laterally). This creates the potential for the canopy to undesirably contact the boat (e.g., the canopy may be repeatedly blown into the boat by a strong wind) and cause damage to the boat.

Also there are side and end curtain devices that attach to the frame of the canopy of a boat hoist or boat dock that can be lowered using gravity to surround the boat below the canopy when the boat is not being used and raised by pulling the curtains up when boat to the access is desired. Similar devices have also been used on motorcycle covers, golf cart covers, recreational vehicle covers and personal watercraft/jet ski covers.

If there is a mechanical issue with the drawstring system (motor failure, etc.), it is very difficult to manually actuate the system to get access to the boat.

Systems that only move one side or end at a time create a dangerous wind load condition for boat lifts. Many boat lift structures are not anchored to the sea bed. When the weight of the boat is not in lift (when out boating), the large surface area of the unmoved sides quickly create forces that can roll over or damage the boat lift structure.

Additionally, the aforementioned prior art curtain systems cannot be quickly installed and removed from boat slips and boat lifts to allow for easy seasonal storage.

Accordingly, there is a need for a side curtain deployment system on canopy assemblies that overcomes the drawbacks of prior art systems.

SUMMARY OF THE INVENTION

The present invention relates generally to an apparatus for the deployment of four curtains for the sides of boat 'wet slips' and boat lifts, car ports or the like. A synchronized roller system is provided to roll up or down each of the four curtains that surround a space to be enclosed by the curtain system.

BRIEF DESCRIPTION OF THE DRAWINGS

The above mentioned disadvantages of prior art curtain systems are at least partially overcome by the present invention for example by employment of an apparatus described in the following detailed description, particularly when studied in conjunction with the drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
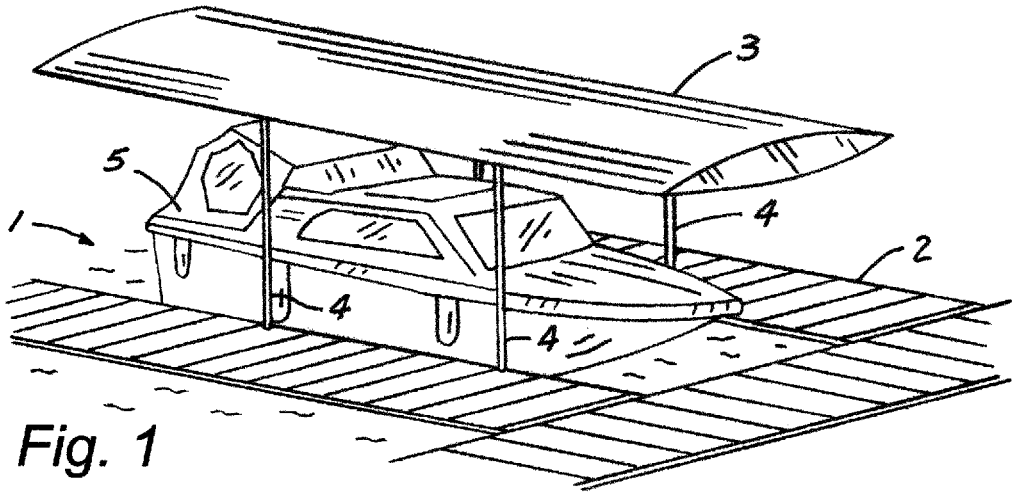
FIG. 1 is a prior art perspective view of a boat in a slip with a boat hoist in the slip.

Referring now to the drawings wherein like reference numerals designate identical or corresponding parts throughout the several views, FIG. 1 shows a prior art wet boat slip 1 and boat dock 2 with a canopy 3 supported by vertical posts 4, and showing a boat 5 in the slip 1 under the canopy 3. The vertical posts can be part of a boat lift (not shown) or just attached to the dock 2.

Figure 2:
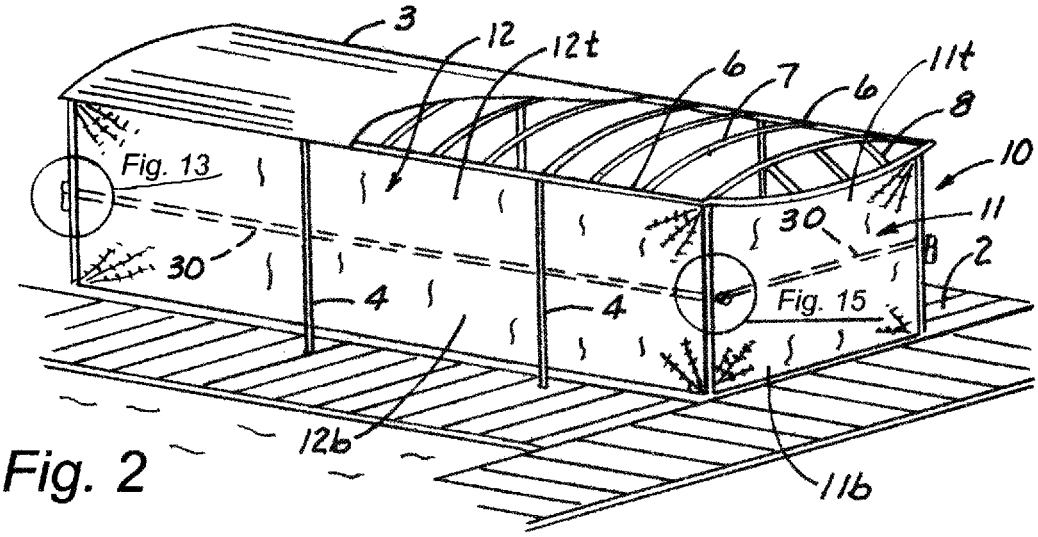
FIG. 2 is a perspective view like FIG. 1, but showing the curtain apparatus of the present invention deployed round the boat and suspended from a top rectangular frame of the top of the boat hoist.

FIG. 2 shows the canopy 3 supported by a rectangular peripheral frame 6 with intermediate members 7 and 8 attached thereto to provide support to the canopy 3, which canopy is typically made of a waterproof canvas cloth. FIG. 2 also shows a curtain support and deployment system 10 constructed in accordance with the present invention in the deployed position to shield the boat 5 from the elements, primarily from wind and rain, but also to inhibit intrusion by strangers or pests such as birds and bugs.

Figure 8:
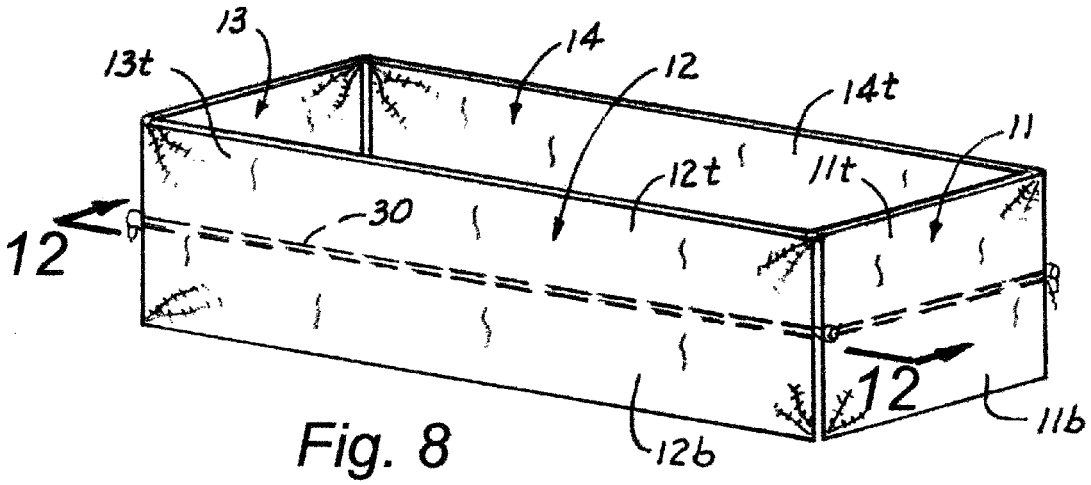
FIG. 8 is a perspective view of the curtain apparatus alone for illustrative purposes without showing it attached to the frame of the boat hoist.

As shown best in FIG. 8, the curtain support and deployment system 10 has first, second, third and fourth curtains 11, 12, 13 and 14 respectively. First and third curtains 11 and 13 are identical end curtains and second and fourth curtains 12 and 14 are identical side curtains. Curtains 11-14 have top/upper portions 11*t*, 12*t*, 13*t* and 14*t* respectively and bottom/lower portions 11*b*, 12*b*, 13*b* and 14*b* respectively.

Figure 3:
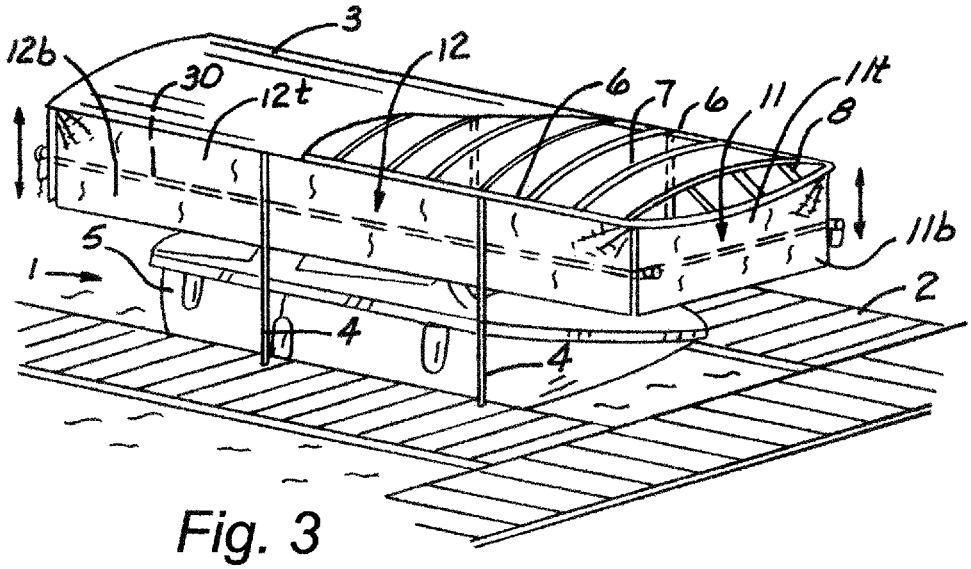
FIG. 3 is a perspective view like FIG. 2 but showing the curtain apparatus in the process of being raised.
Figure 4:
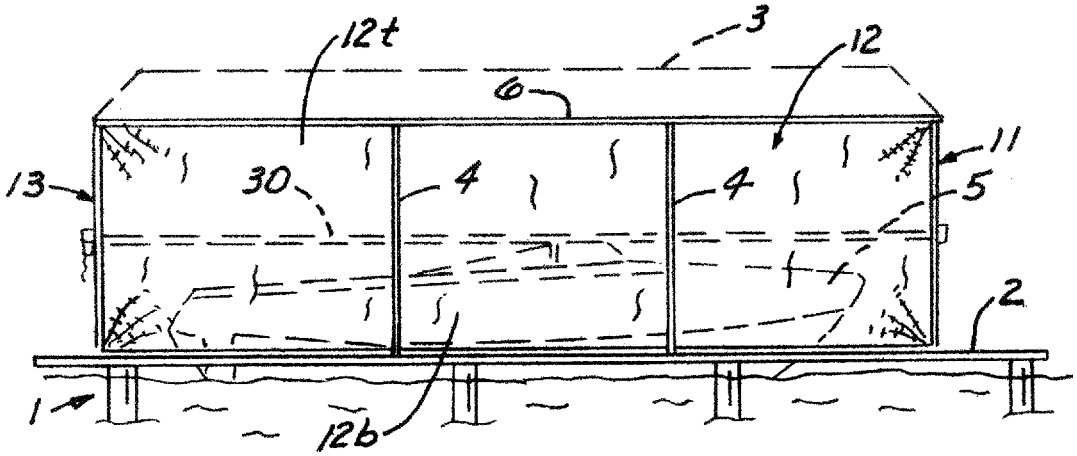
FIG. 4 is a side elevational view showing the curtain apparatus completely lowered.
Figure 5:
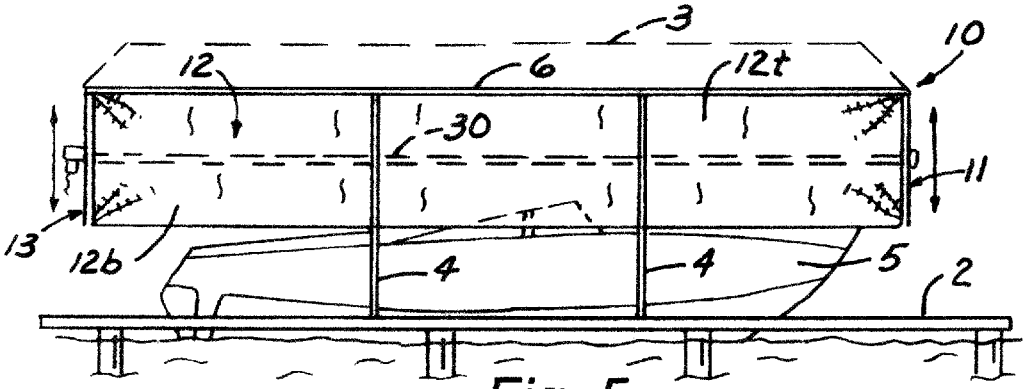
FIG. 5 is a side elevational view like FIG. 3 with the curtain apparatus in an intermediate position between fully up and fully down.
Figure 6:
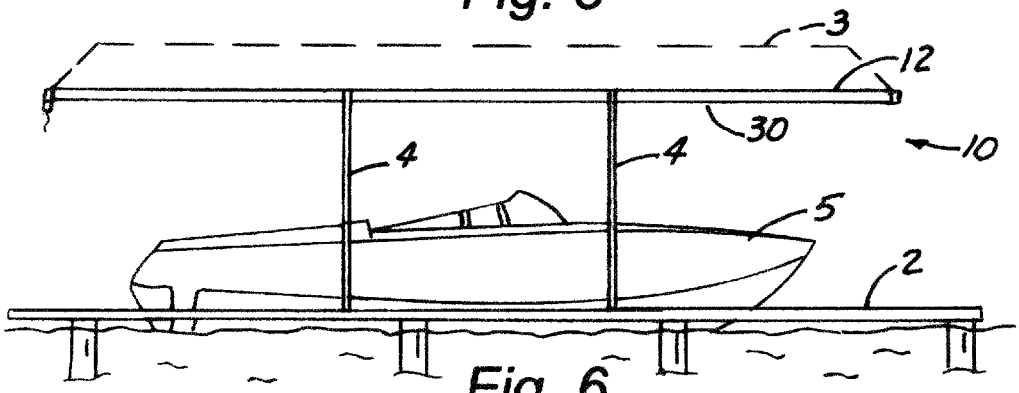
FIG. 6 is a side elevational view with the curtain being fully raised.

FIGS. 2, 4 and 8 show the curtain support and deployment system 10 fully deployed so as to protect the boat as indicated above. FIGS. 3 and 5 show the curtain support and deployment system 10 partially retracted on its way up or down. FIG. 6 shows the curtain support and deployment system 10 fully raised to provide complete access to the boat 5.

Figure 7:
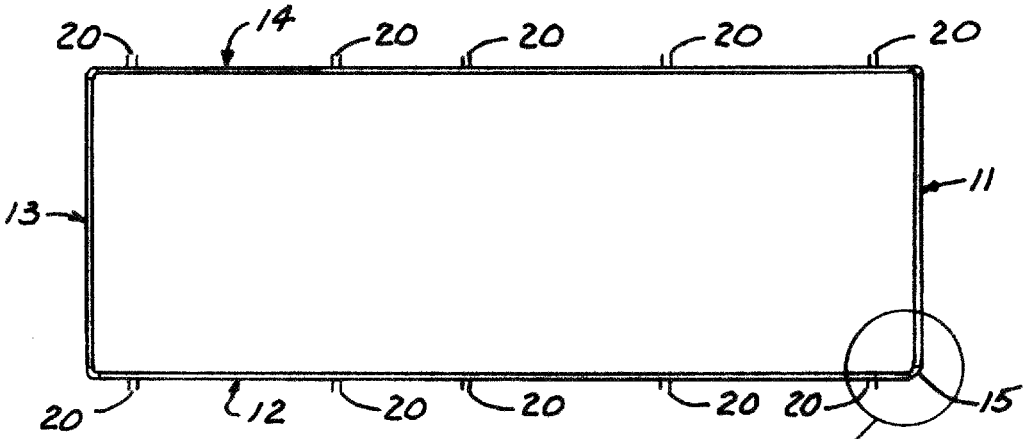
FIG. 7 is a view of the top of each one of four curtains shown schematically attached to an upper rectangular shaped metal frame showing the position of clamps, the clamps being shown in detail in FIGS. 9-11.

FIGS. 7 and 9-11 show a clamping structure 20 for attaching the top of each curtain 11-14 to the top peripheral frame part 6 of the canopy 3 support frame. FIG. 7 shows the approximate placement of the clamping structures 20 to the peripheral frame part 6. More or fewer clamping structures 20 can be used.

Figure 9:
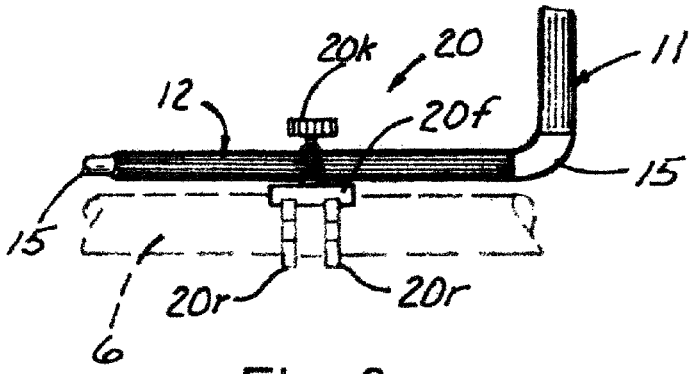
FIG. 9 is a view of the structure, shown only schematically within the circle of FIG. 7, in more detail for attaching the top of the curtain to the frame of the boat hoist.
Figure 10:
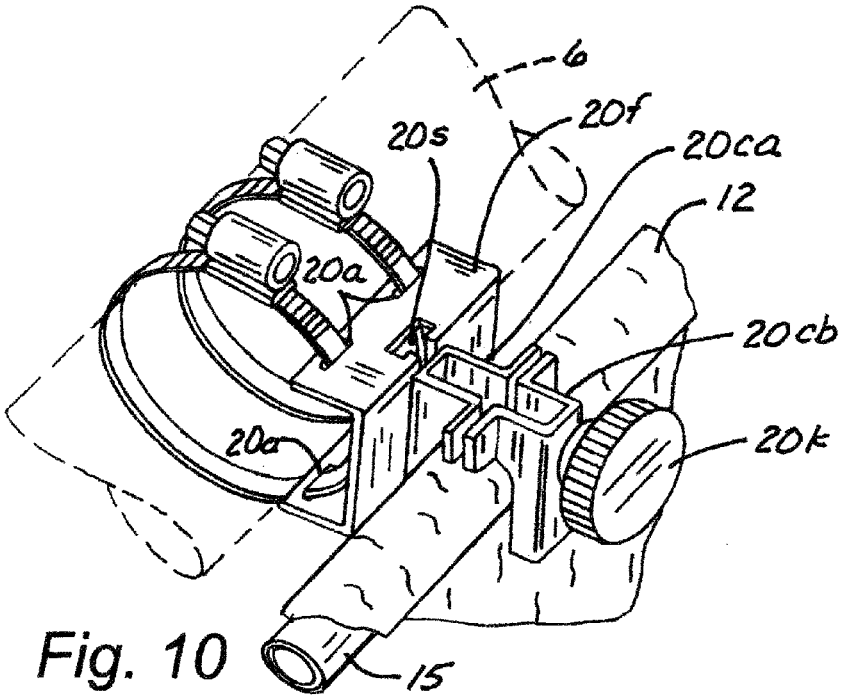
FIG. 10 is a perspective view of the attachment structure for attaching the top of the curtain to the top outer periphery of the frame of the roof structure of the boat hoist.
Figure 11:
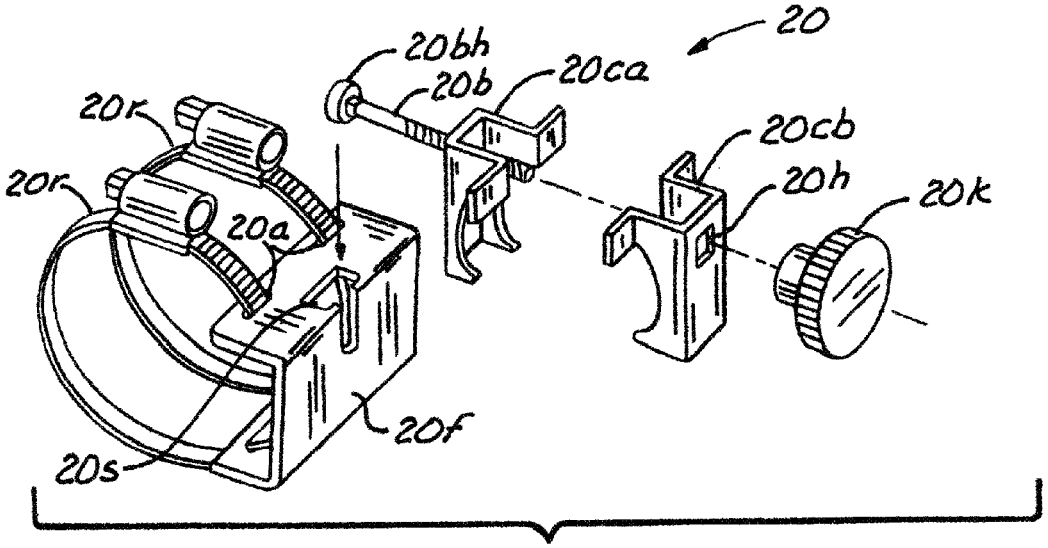
FIG. 11 is an exploded view of the attachment structure shown in FIG. 10.

Referring now to FIGS. 9-11, the clamps 20 have a main frame 20*f* with four apertures 20*a* therein for receiving adjustable radiator type clamps 20*r*. Identical mating curtain clamp parts 20*ca* and 20*cb* extend around the rectangular shaped top curtain rod/support tube 15 as shown in FIG. 10 which tube 15 has a portion of the top 12*t* of curtain 12 connected to it. The clamp parts 20*ca* and 20*cb* are held together by a bolt 20*b* that extends through holes 20*h* in clamp parts 20*ca* and 20*cb* and is threadably engaged by female threaded knob 20*k*. Then, the head 20*bh* of each respective pair of clamp parts 20*ca* and 20*cb* is received into slot 20*s* from the top as shown by the arrow in FIG. 11. It is to be understood that preferably all of the clamp frames 20*f* would first be attached to the canopy peripheral frame 6 first; then all of the clamp parts 20*ca* and 20*cb* would be installed on curtains 11-14 in the same spaced relationship that the frames 20*f* are on canopy peripheral frame 6. That way the entire curtain assembly 10 can just be lifted by its respective top rectangular frame 15 for example in the same way that canopy 12 is connected as shown in FIG. 10. The entire curtain assembly 10 can then be first raised and then lowered into place so that each respective bolt head 20*bh* extends into each respective slot 20*s* in each respective clamp frame 20*f* that is already attached to the peripheral frame part 6. Other sequences of connection of these parts can be done instead if desired.

Figure 12A:
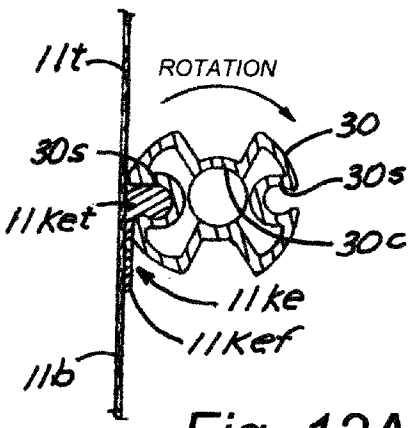
FIG. 12A is a cross sectional view taken along line 12A-12A of FIG. 12 to show how the curtains are attached to the rotors.
Figure 12B:
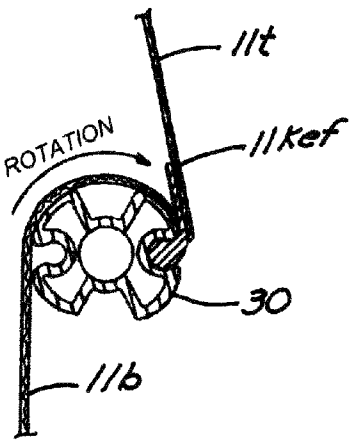
FIG. 12B is a cross sectional view similar to FIG. 12A but shows the rotor having made one revolution to show how the top half and the bottom half of the curtains overlap each other as they are rolled onto the rotor.
Figure 12:
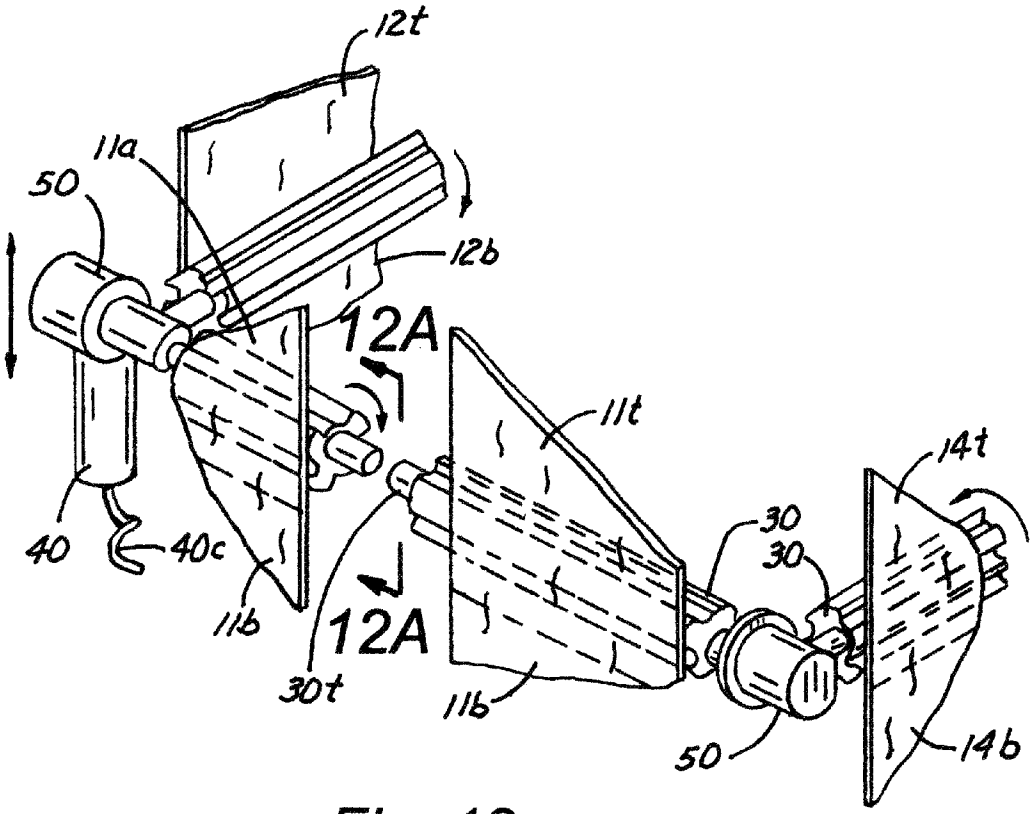
FIG. 12 is an exploded perspective view of three of four rotors to which the curtains are respectively attached and showing how one of two motors is arranged to rotate meshing gears to rotate all four rotors.

Each of the curtains 11-14 are actuated by a system shown best in FIGS. 12 and 12A. FIG. 12A shows how the curtains are attached to rollers 30 using a "Keder extrusion" 11*ke* with a flap portion 11*kef* sewn to the respective curtain 11-14 and a "Keder extrusion" tube 11*ket* which is pushed into one of a pair of complementary shaped slots 30*s* in rotor 30 to hold the middle of the curtain 11 fixed with respect to rotor 30. The "Keder extrusion" is usually a one piece extrusion, including parts 11*ket* and 11*kef*. It is to be understood that in this preferred embodiment each of the other curtains 12-14 has the same or similar "Keder extrusion" structure for affixing the respective curtain to a respective rotor 30 as that shown in FIG. 12A. A tube 30*t* in center opening 30*c* of each rotor 30 is fixed with respect to tube 30*t* so that each rotor 30 and tube 30*t* rotate together.

Two motors 40 and four idlers 50 are provided in the preferred embodiment 10 to selectively turn the rotors 30 in one direction to roll the respective curtains onto the rotors 30 from the position shown in FIGS. 2, 4 and 8 to the positions shown in FIG. 6, with positions of the curtains 11-14, motors 40 and idlers 50 shown in FIG. 5 being an intermediate position in the rolling or unrolling process.

Figure 13:
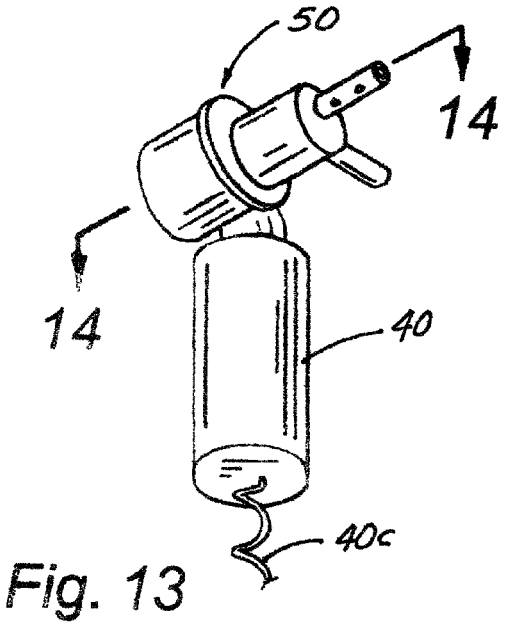
FIG. 13 is a perspective view within the circle of FIG. 2 showing a motor attached to an idler gear structure for selectively providing reversible power to rotate all gears and rotors shown in FIG. 17.
Figure 14:
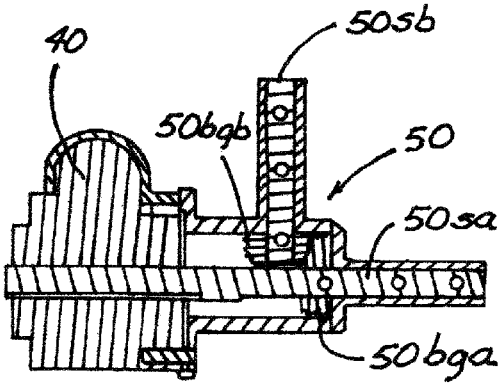
FIG. 14 is a cross sectional view taken along line 14-14 to show the motor and meshing bevel gears attached to respective rotors where the four rotors meet at the corners shown in FIG. 17.
Figure 15:
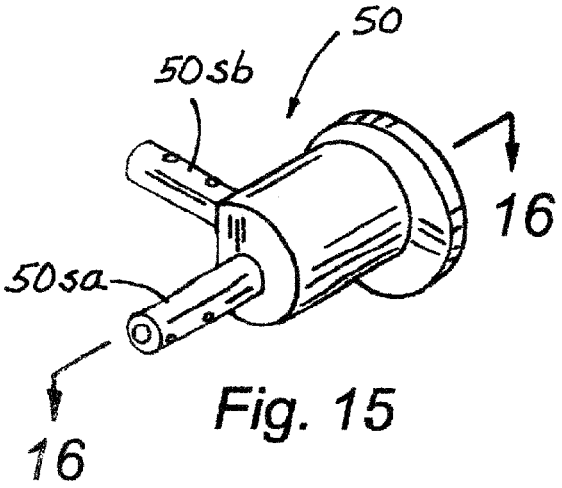
FIG. 15 is a view within the circle of FIG. 2 showing an idler mechanism to transfer rotational torque in two rotary directions to the rotors via power transmitted to one or more of the four rotors or eight gears of the preferred embodiment.
Figure 16:
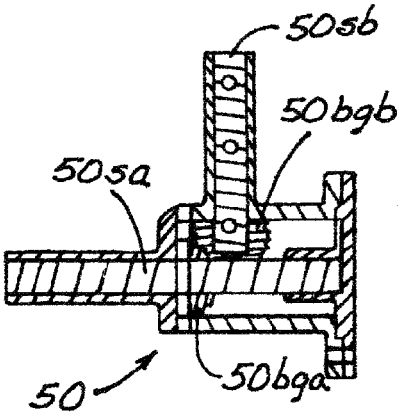
FIG. 16 is a cross sectional view taken along lines 16-16 of FIG. 15 to show two meshing bevel gears attached at the corner of two of the rotors for transmitting power among all of the interconnected rotors and gears.
Figure 17:
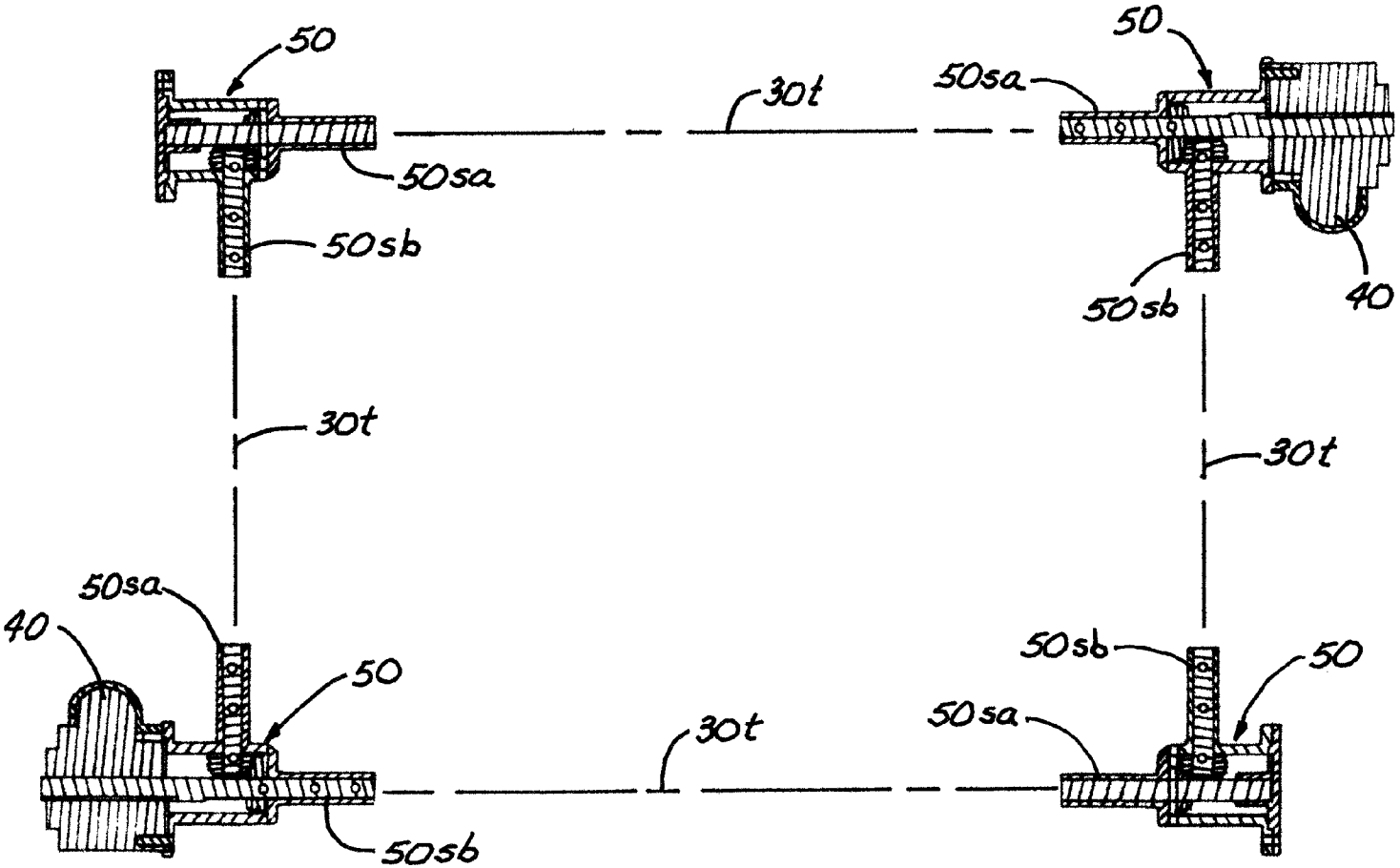
FIG. 17 is a schematic view showing how two matching or identical motors drive four matching or identical idler boxes, each idler box containing two meshing bevel gears attached to respective rotors.

FIG. 17 shows two motors 40, which can be electric, hydraulic or pneumatic, having power coming from line 40*c* as shown in FIG. 13. These motors 40 (FIG. 16) turn a bevel gear 50*bga* on a shaft 50*sa* in each idler 40. This bevel gear is meshed with another bevel gear 50*bgb* attached to shaft 50*sb* so that when the motor 50 turns shaft 50*sa*, the bevel gear 50*bga*, attached rigidly thereto, turns in the same direction and at the same speed as shaft 50*sa*. This turning of bevel gear 50*bga* turns meshing identical bevel gear 50*bgb*, which is rigidly attached to shaft 50*sb*. Each of the shafts 50*sa* and 50*sb* are rigidly attached to respective tubes 30*t*, which are rigidly attached to rotors 30. So rotation of the shafts 50*sa* and 50*sb* from the idlers 40 and motors 50 will cause rotors 30 to rotate as well. Because all of the gears in all fours of the idlers 40 are identical and because motors 40 are essentially identical, all of the rotors 30 will be rotated in a synchronized fashion in the same direction and at the same speed.

In operation of the embodiment shown in FIGS. 2-17, to move the curtains 11-14 from the lowered position shown in FIG. 2 to the raised position in FIG. 6, the motors 40 would be actuated to turn the rotating parts shown in FIGS. 12 and 17 in a first synchronized rotary direction until the curtains 11-16 are in the raised position shown in FIG. 6. FIG. 12B shows how the upper half of each curtain (e.g. 12*t*) and lower curtain (e.g. 12*b*) overlap as they roll onto the rotor 30. Then, when it is desired to move the curtains 11-14 to the lowered position shown in FIG. 2, the motors 40 direction is reversed to turn all of the rotating parts shown in FIGS. 12 and 17 in an opposite direction until the curtains 11-14 are fully lowered to the FIG. 2 position thereof.

Figure 18:
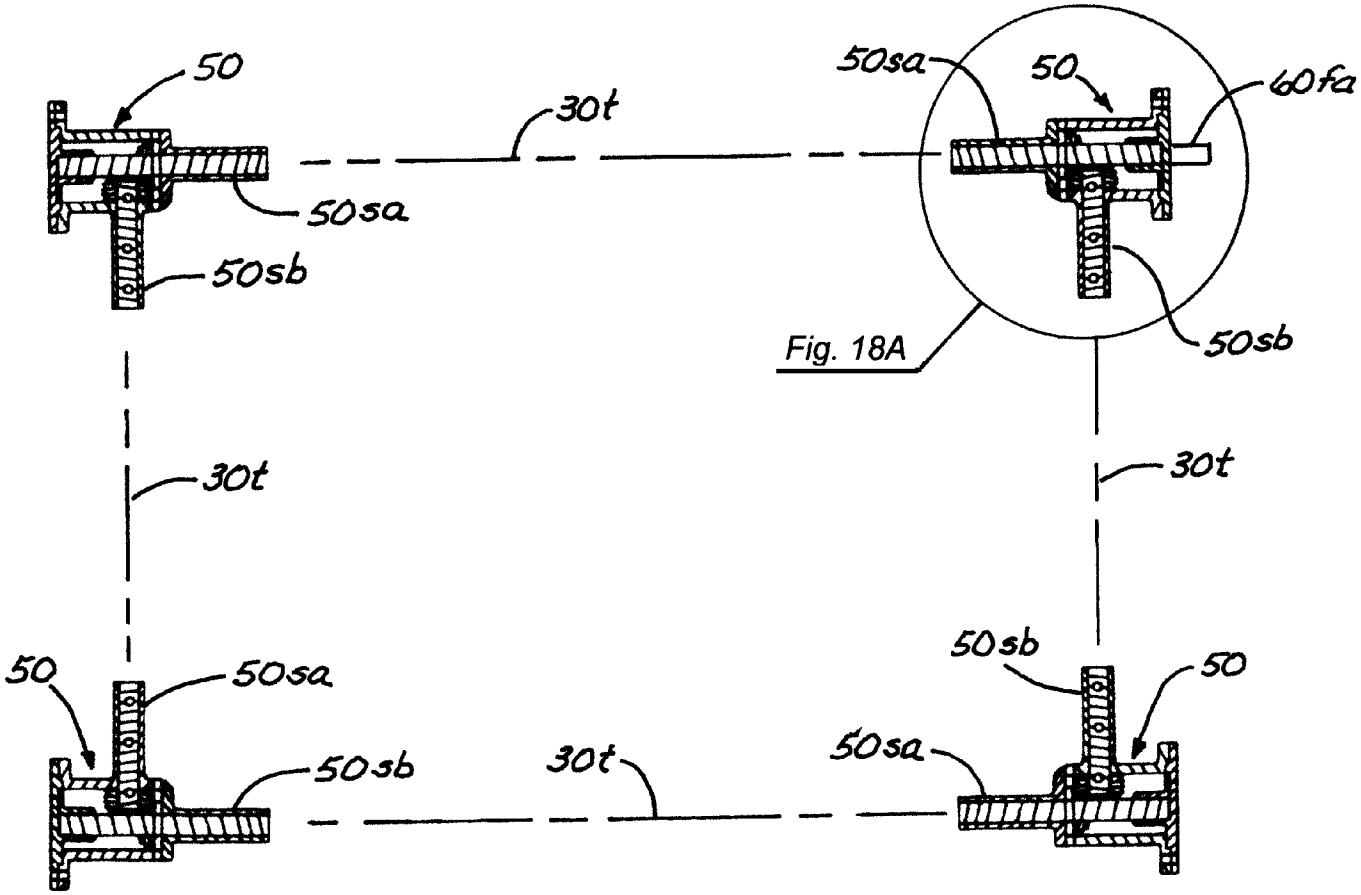
FIG. 18 is a schematic view like FIG. 17, but is provided with structure in the circle of FIG. 18A of FIG. 18 to permit a user to use a hand crank as shown in FIGS. 18A and 18B to turn the rotors in either rotary direction in lieu of using a motor or motors as shown in FIG. 17.
Figure 18A:
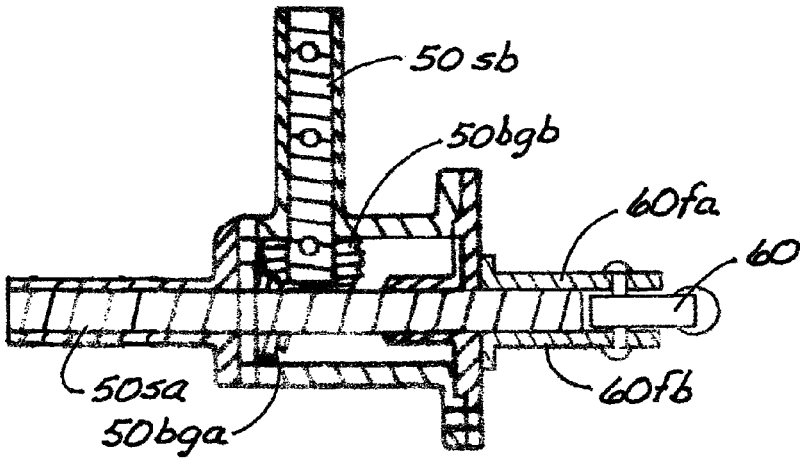
FIG. 18A is a cross sectional view taken from within the circle of FIG. 18 showing an idler box and how it can be connected to a hand crank.
Figure 18B:
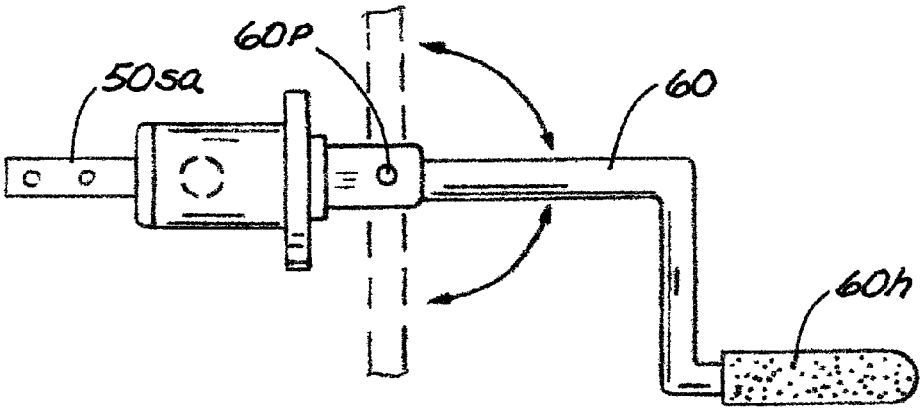
FIG. 18B is a side elevational view take from within the circle of FIG. 18 but adding a crank for turning one of the bevel gears and thereby all of the interconnected bevel gears and rotors at the same time and at the same speed in one rotary direction or the other rotary direction.

Looking now to the embodiment shown in FIGS. 18, 18A and 18B, it is noted that everything is the same except that instead of motors 40, the system is cranked by hand using crank handle 60 to rotate the shaft 50*sa*. The crank 60 is pivotally attached by a pin 60*p* that extends through openings in flanges 60*fa* and 60*fb* and though an opening not specifically shown in FIGS. 18B and 18B. So to turn the rotors 30 to roll the curtains 11-14 onto rotors 30 from the position shown in FIG. 2 to FIG. 6 a person just keeps cranking on the crank 60 until it is impossible to crank it any more in one direction. The crank 60 would then be held in place or kept from rotating to keep the curtains 11-14 from unrolling from the rotors. Or if it is desired to remove the crank 60 by taking out the pin 60*p*, it is noted that locking or preventing any one of the rotating elements of FIG. 18 in place will keep all of the other rotating elements from rotating as well. To let the curtains 11-14 down, the rotary cranking direction can be reversed slowly from the FIG. 6 to the FIG. 2 positions thereof.

Figure 19:
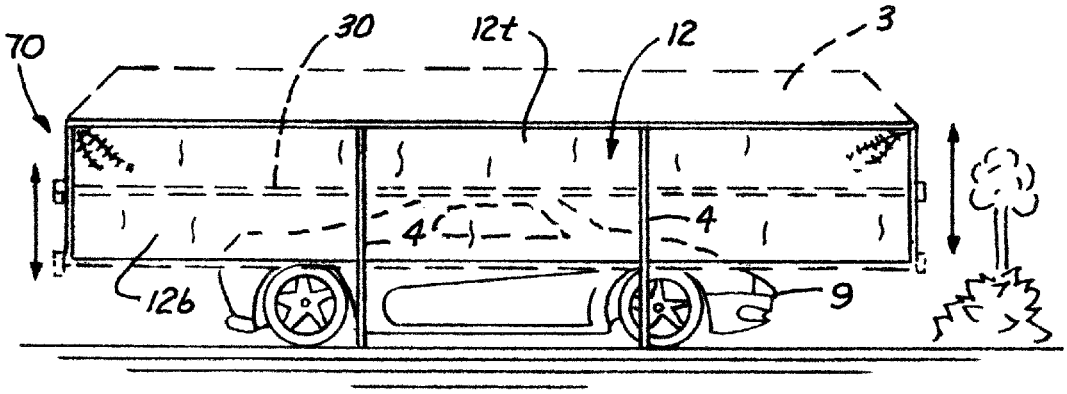
FIG. 19 is a view of the present invention being used on a carport or portable automobile shelter.

FIG. 19 shows an alternate embodiment wherein the a curtain support and deployment system 70 is identical to the curtain support and deployment system 10 except that it is used on a car shelter to shelter a car 9 or any other vehicle or item which is desired to be sheltered from the elements of rain, snow, wind, etc. but which needs to be accessed easily from time to time. The motors 40, idlers 50 shown in solid line and rotor 30 shown in upper dashed lines works just like the curtain deployment system shown in FIGS. 2-18.

It is to be understood that while the preferred embodiment 10 illustrates the rotors 30 in the middle of each curtain 11-14, the rotors 30 could just be at the bottom of each one of the curtains 11-14, especially when not in an on water boating environment as shown in FIGS. 2-17. In that case the rotors would just need to rotate more turns to roll up the entire curtain, instead of having the top 11*t*, 12*t*, 13*t* and 14*t* and bottom portions 11*b*, 12*b*, 13*b* and 14*b* of the curtains 11-14 overlap each other as they would in using the embodiment 10 shown in FIGS. 2-19.

The aforementioned alternate embodiment is shown in dashed lines in FIG. 19. FIG. 19 shows the dashed line motors 40, idlers 50 at the bottom of the curtain 12. In this optional dashed line embodiment, the motors 40, idlers 50 and rotors 30 can just hang from the bottom of the curtains 11-14 and just make more rotations to roll up the curtain completely instead of having an overlapping upper half and lower half of the curtains as shown by example in FIG. 12B. This dashed line embodiment is especially adapted to use in non-boating environments because in a boat slip or boat lift environment the motors 40, idlers 50 and rotors 30 would be disposed close to the top of the water, which is not ideal as compared to a car port situation wherein the motors 40, idlers 50 and rotors 30 would act as a weight on the bottom of the curtains to hold the bottom of the curtain on or close to the ground.

While not required, when a user is out boating, it is preferred that all four sides be left in a retracted or lowered position thereof, thereby reducing wind load on boat lift structures.

The use of mesh material on the curtains 11-14 is also an optional feature that allows the fabric to dry out when rolled—allowing the retracted system to be stored on a boat lift in the offseason. Using this option can eliminate the need to remove the curtains for storage as well.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

I claim:

1. A curtain apparatus comprising:

a first elongated member disposed generally along a first horizontal axis for rotation about the first horizontal axis;

a first curtain having a top, bottom, first end and second end, the top of the first curtain being adapted to be attached to a frame disposed above the first elongated member;

the first elongated member being suspended from the frame by the first curtain whereby the first elongated member moves up when rotated in the first rotary direction as the first curtain is rolled onto the first elongated member and the first elongated member moves down when rotated in the second rotary direction and the first curtain is being unrolled from the first elongated member;

a second elongated member disposed generally along a second horizontal axis for rotation about the second horizontal axis;

a second curtain having a top, bottom, first end and second end, the top of the second curtain being adapted to be attached to the frame disposed above the second elongated member;

the second elongated member being suspended from the frame by the second curtain whereby the second elongated member moves up when rotated in the first rotary direction as the second curtain is rolled onto the second elongated member and the second elongated member moves down when rotated in the second rotary direction and the second curtain is being unrolled from the second elongated member;

a third elongated member disposed generally along a third horizontal axis for rotation about the third horizontal axis;

a third curtain having a top, bottom, first end and second end, the top of the third curtain being adapted to be attached to the frame disposed above the third elongated member;

the third elongated member being suspended from the frame by the third curtain whereby the third elongated member moves up when rotated in the first rotary direction as the third curtain is rolled onto the third elongated member and the third elongated member moves down when rotated in the second rotary direction and the third curtain is being unrolled from the third elongated member;

a fourth elongated member disposed generally along a fourth horizontal axis for rotation about the fourth horizontal axis;

a fourth curtain having a top, bottom, first end and second end, the top of the fourth curtain being adapted to be attached to the frame disposed above the fourth elongated member;

the fourth elongated member being suspended from the frame by the fourth curtain whereby the fourth elongated member moves up when rotated in the first rotary direction as the fourth curtain is rolled onto the fourth elongated member and the fourth elongated member moves down when rotated in the second rotary direction and the fourth curtain is being unrolled from the fourth elongated member;

a left gear operatively attached to a left end of the first elongated member;

a right gear operatively attached to a right end of the first elongated member;

a left gear operatively attached to a left end of the second elongated member;

a right gear operatively attached to a right end of the second elongated member;

a left gear operatively attached to a left end of the third elongated member;

a right gear operatively attached to a right end of the third elongated member;

a left gear operatively attached to a left end of the fourth elongated member;

a right gear operatively attached to a right end of the fourth elongated member;

the left gear of the first elongated member being operatively engaged with the right gear of the second elongated member;

the left gear of the second elongated member being operatively engaged with the right gear of the third elongated member;

the left gear of the third elongated member being operatively engaged with the right gear of the fourth elongated member; and the left gear of the fourth elongated member being operatively engaged with the right gear of the first elongated member whereby rotation of any one of the first, second, third or fourth gears causes all of the other gears and elongated members to rotate.

2. The curtain apparatus of claim 1 further comprising a motor operatively attached to at least one of the gears to selectively cause the at least one gear to rotate.

3. The curtain apparatus of claim 1 further comprising a second motor operatively attached to at another one of the gears to selectively cause the another gear to assist rotation of first, second, third and fourth gears.

4. The curtain apparatus of claim 1 further comprising a crank operatively attached to at least one of the gears to selectively cause the at least one gear to rotate when the crank is rotated.

5. The curtain apparatus of claim 1 wherein all of the gears are bevel gears.

6. The curtain apparatus of claim 1 wherein all of the curtains are comprised of mesh material.

7. A curtain apparatus comprising:

a first elongated member disposed generally along a first horizontal axis for rotation about the first horizontal axis;

a first curtain having a first upper curtain portion, the first upper curtain portion having a top, bottom, first end and second end, the bottom of the first upper curtain member being attached to the first elongated member, the top of the first upper curtain portion being adapted to be attached to a frame disposed above the first elongated member;

the first curtain also having a first lower curtain portion having a top, bottom, first end and second end, the top of the first lower curtain portion being attached to the first elongated member whereby rotation of the first elongated member in a first rotary direction will cause the first upper and first lower curtain portions to roll onto the first elongated member and rotation of the first elongated member in a second rotary direction will cause the first upper and first lower curtain members to unroll from a rolled condition;

the first elongated member being suspended from the frame by the first upper curtain portion whereby the first elongated member moves up when rotated in the first rotary direction as the first upper curtain portion is rolled onto the first elongated member and the first elongated member moves down when rotated in the second rotary direction and the first upper curtain portion is being unrolled from the first elongated member;

a second elongated member disposed generally along a second horizontal axis for rotation about the second horizontal axis;

a second curtain having a second upper curtain portion, the second upper curtain portion having a top, bottom, first end and second end, the bottom of the first upper curtain member being attached to the second elongated member, the top of the second upper curtain portion being adapted to be attached to a frame disposed above the second elongated member;

the second curtain also having a second lower curtain portion having a top, bottom, first end and second end, the top of the second lower curtain portion being attached to the second elongated member whereby rotation of the second elongated member in a first rotary direction will cause the second upper and second lower curtain portions to roll onto the elongated member and rotation of the second elongated member in a second rotary direction will cause the second upper and second lower curtain members to unroll from a rolled condition;

the second elongated member being suspended from the frame by the second upper curtain portion whereby the second elongated member moves up when rotated in the first rotary direction as the second upper curtain portion is rolled onto the second elongated member and the second elongated member moves down when rotated in the second rotary direction and the second upper curtain portion is being unrolled from the second elongated member;

a third elongated member disposed generally along a third horizontal axis for rotation about the third horizontal axis;

a third curtain having a third upper curtain portion, the third upper curtain portion having a top, bottom, first end and second end, the bottom of the third upper curtain member being attached to the third elongated member, the top of the third upper curtain portion being adapted to be attached to a frame disposed above the third elongated member;

the third curtain also having a third lower curtain portion having a top, bottom, first end and second end, the top of the third lower curtain portion being attached to the third elongated member whereby rotation of the third elongated member in a first rotary direction will cause the third upper and third lower curtain portions to roll onto the third elongated member and rotation of the third elongated member in a second rotary direction will cause the third upper and third lower curtain members to unroll from a rolled condition;

the third elongated member being suspended from the frame by the third upper curtain portion whereby the third elongated member moves up when rotated in the first rotary direction as the third upper curtain portion is rolled onto the third elongated member and the third elongated member moves down when rotated in the second rotary direction and the third upper curtain portion is being unrolled from the third elongated member;

a fourth elongated member disposed generally along a fourth horizontal axis for rotation about the fourth horizontal axis;

a fourth curtain having an upper curtain portion, the fourth upper curtain portion having a top, bottom, first end and second end, the bottom of the fourth upper curtain member being attached to the fourth elongated member, the top of the fourth upper curtain portion being adapted to be attached to a frame disposed above the fourth elongated member;

the fourth curtain also having a fourth lower curtain portion having a top, bottom, first end and second end, the top of the fourth lower curtain portion being attached to the fourth elongated member whereby rotation of the fourth elongated member in a first rotary direction will cause the fourth upper and fourth lower curtain portions to roll onto the fourth elongated member and rotation of the fourth elongated member in a second rotary direction will cause the fourth upper and fourth lower curtain members to unroll from a rolled condition;

the fourth elongated member being suspended from the frame by the fourth upper curtain portion whereby the fourth elongated member moves up when rotated in the first rotary direction as the fourth upper curtain portion is rolled onto the fourth elongated member and the fourth elongated member moves down when rotated in the second rotary direction and the fourth upper curtain portion is being unrolled from the fourth elongated member;

a left gear operatively attached to a left end of the first elongated member;

a right gear operatively attached to a right end of the first elongated member;

a left gear operatively attached to a left end of the second elongated member;

a right gear operatively attached to a right end of the second elongated member;

a left gear operatively attached to a left end of the third elongated member;

a right gear operatively attached to a right end of the third elongated member;

a left gear operatively attached to a left end of the fourth elongated member;

a right gear operatively attached to a right end of the fourth elongated member;

the left gear of the first elongated member being operatively engaged with the right gear of the second elongated member;

the left gear of the second elongated member being operatively engaged with the right gear of the third elongated member;

the left gear of the third elongated member being operatively engaged with the right gear of the fourth elongated member; and the left gear of the fourth elongated member being operatively engaged with the right gear of the first elongated member whereby rotation of any one of the first, second, third or fourth gears causes all of the other gears and elongated members to rotate.

8. The curtain apparatus of claim 7 further comprising a motor operatively attached to at least one of the gears to selectively cause the at least one gear to rotate.

9. The curtain apparatus of claim 7 further comprising a second motor operatively attached to at another one of the gears to selectively cause the another gear to assist rotation of first, second, third and fourth gears.

10. The curtain apparatus of claim 7 further comprising a crank operatively attached to at least one of the gears to selectively cause the at least one gear to rotate when the crank is rotated.

11. The curtain apparatus of claim 7 wherein all of the gears are bevel gears.

12. The curtain apparatus of claim 7 wherein all of the curtains are comprised of mesh material.

* * * * *